United States Patent [19]

Hogen Esch

[11] Patent Number: 5,068,641

[45] Date of Patent: Nov. 26, 1991

[54] DETECTION LABEL FOR AN ANTI-SHOP-LIFTING SYSTEM

[75] Inventor: Johannes H. L. Hogen Esch, Aalten, Netherlands

[73] Assignee: N.V. Nederlandsche Apparatenfabriek Nedap, De Groenlo, Netherlands

[21] Appl. No.: 483,226

[22] Filed: Feb. 23, 1990

[30] Foreign Application Priority Data

Feb. 24, 1989 [NL] Netherlands ..... 8900461

[51] Int. Cl.[5] ..... G08B 13/24

[52] U.S. Cl. ..... 340/551; 340/572

[58] Field of Search ..... 340/551, 572

[56] References Cited

U.S. PATENT DOCUMENTS

| | | | |
|---|---|---|---|
| 3,713,133 | 1/1973 | Nathans | 340/572 X |
| 4,695,845 | 9/1987 | Hildt | 340/572 X |
| 4,742,341 | 5/1988 | Hogen Esch | 340/572 |
| 4,751,500 | 6/1988 | Minasy et al. | 340/572 |
| 4,774,504 | 9/1988 | Hartings | 340/572 |
| 4,812,811 | 3/1989 | Asbrink et al. | 340/572 X |
| 4,847,592 | 7/1989 | Hogen Esch et al. | 340/572 |
| 4,940,968 | 7/1990 | De Nood | 340/572 |

FOREIGN PATENT DOCUMENTS

| | | |
|---|---|---|
| 0266294 | 5/1988 | European Pat. Off. . |
| 2180680 | 4/1987 | United Kingdom . |

*Primary Examiner*—Glen R. Swann, III
*Assistant Examiner*—Mullen, Jr. Thomas J.
*Attorney, Agent, or Firm*—Fleit, Jacobson, Cohn, Price, Holman & Stern

[57] ABSTRACT

A detection label for an anti-shoplifting system, comprises a housing (2) accommodating an electrical circuit (21) detectable by an electromagnetic interrogation field, a needle (1) for securing the detection label to an article to be safeguarded, and a locking device (4, 8, 9) for locking the needle. The housing includes a fixed clip (3) which together with the rest of the housing encloses a slot-like free space, a cavity (7) for receiving the tip of the needle (1) which is placed within the housing, an operating push button device (4, 6) for moving the needle towards the clip, and a guide bore (20) in a fabric clamp (6) for guiding the needle during its movement toward the clip.

20 Claims, 4 Drawing Sheets

DETECTION LABEL FOR AN ANTI-SHOP-LIFTING SYSTEM

This invention relates to a detection label for an anti-shoplifting system, comprising a housing accommodating an electrical circuit which by means of an electromagnetic interrogation field can be detected, a needle by means of which the detection label can be secured to an article to be safeguarded, and locking means for locking the needle.

Such detection labels, sometimes referred to as wafers or responders or transponders, are known in practice in various embodiments. One example of a known wafer is described in British patent specification 1 570 508 (Nedap). In the prior wafers, the housing is provided with a lock in which the shank of the needle or spike can be locked. The head of the needle or spike is secured in the free end of a flexible arm, the other end of which is secured to the housing. The needle or spike is to be inserted into the lock through an aperture in the article to be safeguarded, or in the case of textiles, through the fabric of the article. The lock can in most cases be unlocked magnetically.

The electrical circuit of the prior wafers for anti-shoplifting systems comprises a tuned circuit which comes into the resonant state in an interrogation field. The signal generated by the tuned resonant circuit can be detected with a receiver. Often, however, the energy absorbed by the circuit of the wafer is detected at the end of the transmitter which generates the interrogation field. The wafer according to the invention is suitable for both types of systems.

In practice, inserting the needle and fixing it turns out to be a cumbersome operation, because the positioning of the needle in the opening provided in the wafer for the purpose requires some degree of accuracy, for which coordinated manipulation by both hands is needed.

Another drawback of the prior wafers is that an alarm signal is only generated when the wafer is introduced into the interrogation field of the transmitter/-receiver. Fraudulent attempts at removing the wafer from clothing without the appropriate uncoupling equipment, however, cannot be detected.

British patent application 2 180 680 describes an anti-shoplifting system which comprises a plurality of safety clips each having a needle which can be stuck through a piece of clothing to be safeguarded and can be locked. These known safety clips, however, are connected through a fixed central device by means of a cord and do not comprise an electrical circuit which can be detected through an electromagnetic interrogation field by wireless means. Also, the known safety clips are not provided with needle guiding means.

European patent application 0 266 294 describes a U-shaped safety clip for shop articles, comprising a needle which can be stuck through a piece of clothing and fixed in that position by means of a lock operable by a key. That safety clip is not provided with means for wireless detection either, but, like the clip described in the above British patent application 2 180 680, can only be used in one particular place, because the clip is provided with a cable inserted through a fixed eye in the shop.

BRIEF SUMMARY OF THE INVENTION

It is an object of the present invention to provide a wafer which does not have the drawbacks outlined above, and to which various security functions can be added in modular form. For that purpose a wafer is provided which has a fixed clip and an integrated needle, whereby the attachment of the wafer to an article is considerably simplified. The movement of the needle it guided through the construction, so that the wafer can be simply attached with one single hand movement. In the attached condition, the article to be protected, for example, a piece of clothing, is secured between the fixed clip and the wafer housing by means of the needle. In order that a alarm signal may be generated when the wafer is subjected to fraudulent manipulations a source of power is needed. If this power source is a battery, it must be possible for it to be removed and replaced when it is exhausted. However, the removal of the power source by unauthorized persons must be impossible, because in this way the wafer might become deactivated, at least as far as the fraud alarm is concerned. Because, in accordance with the present invention, the needle is designed to be within the housing of the label, this creates a simple possibility for one or more batteries to be mounted in a hollow push button which also serves to operate the needle. By adding to the basic structure of the wafer according to the invention a power source and a suitable electronic circuit, it is possible to generate an active alarm signal when the wafer is being tampered with. Signalling that the wafer is being tampered with can be considerably simplified when, in the locked position, the needle is biased into contact with the clip by spring means. In that case when the needle is cut or the clip broken, the needle is pushed further outwardly, which can be utilized to close an electrical contact. In this way an alarm signal can be obtained which in the non-active condition is currentless and so does not consume energy, so that an optimum service life of the batteries is ensured. It is also possible for a wafer according to the invention to be equipped, for example, with a piezoelectric buzzer or bleeper, which sounds a prolonged signal, which has a preventive effect. As it is not possible for a wafer to be secured to all types of goods to be safeguarded in the above-described manner, it is possible, according to the present invention, to use an accessory in the form of a cord or cable or the like. The cord or the cable etc. is inserted through an opening of the article to be safeguarded, and the ends of the cord are connected together and locked by means of the wafer according to the invention. In the wafer in the basic embodiment, the cord or the cable etc. may consist of steel wire which is difficult to cut through, with an eye at each end, through which the needle of the wafer can be inserted. In the embodiment in which a "tamper alarm" can be generated, this alarm function can also be operated, in accordance with this invention, through a specially constructed cord.

BRIEF DESCRIPTION OF THE DRAWINGS

Some embodiments of the invention will now be described, by way of example, with reference to the accompanying drawings wherein.

DETAILED DESCRIPTION

Figure 1:
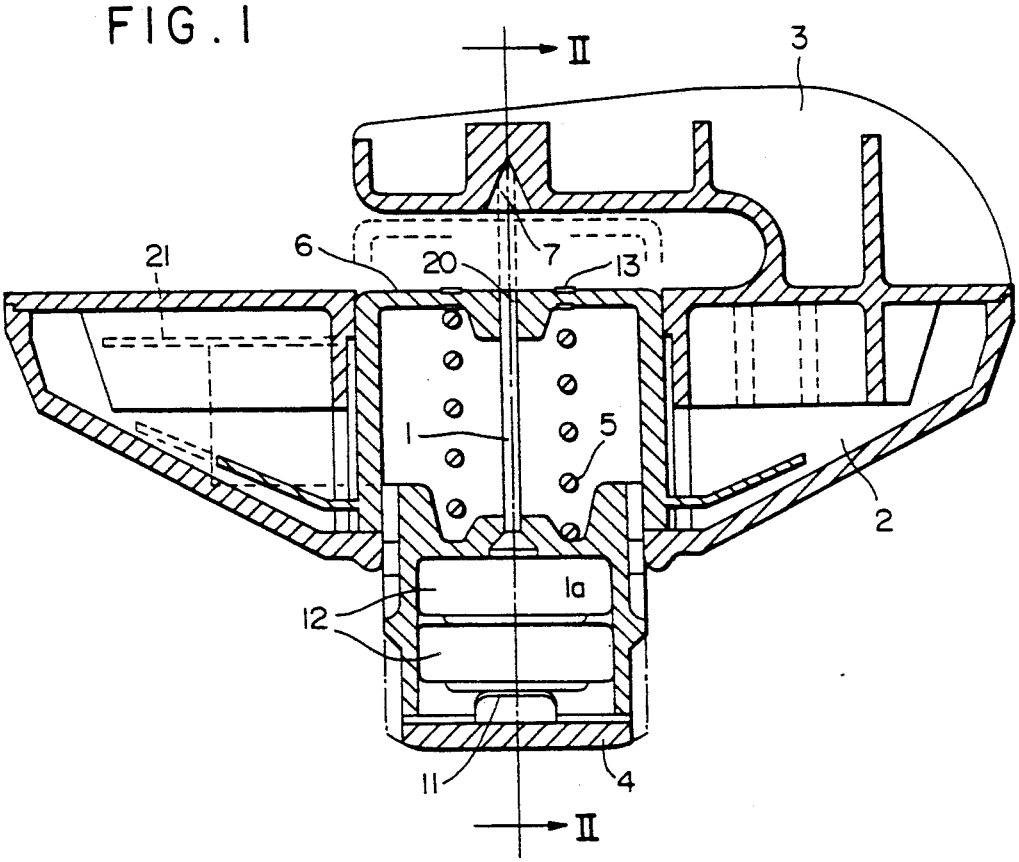
FIG. 1 is a diagrammatic vertical cross-sectional view taken on the line I—I of FIG. 2, and showing one embodiment of a detection label according to this invention.

FIG. 1 shows diagrammatically a cross-sectional view of a wafer or detection label according to the present invention, in which a needle or spike 1 of the wafer is fully within and between a wafer housing 2 and a clip 3, in both the open and the closed position. In the open position, the needle is entirely within the wafer housing 2. Fabric of a piece of clothing can be slipped between the clip 3 and the housing 2. At the bottom of the housing, as viewed in the drawing, there is provided a push button 4 which in the open position projects from the housing. Needle 1 is at the top of push button 4, and is surrounded by a helical spring 5. The shank of the needle or spike points to a cavity 7 in clip 3. In the open position of the wafer, the needle or spike is within a guide bore 20 in the wafer housing, through which it extends in the open position of the wafer. In the embodiment shown, the guide bore is provided in a device 6 which can move towards and away from clip 3, and has a fabric clamping function. The wafer is thus prevented from being suspended exclusively by the needle, which could damage the fabric. In the closed position of the wafer, spring 5 exerts a force on fabric clamping device 6. When push button 4 is pushed into housing 2, the tip of needle 1 is stuck through an article to be safeguarded, such as a piece of clothing, into the cavity 7 of clip 3. In the closed condition, push button 4 is fully sunk within wafer housing 2. Spring 5 is compressed through this operation, so that the fabric of the piece of clothing or other article is clamped between clip 3 and fabric clamp 6.

Figure 2:
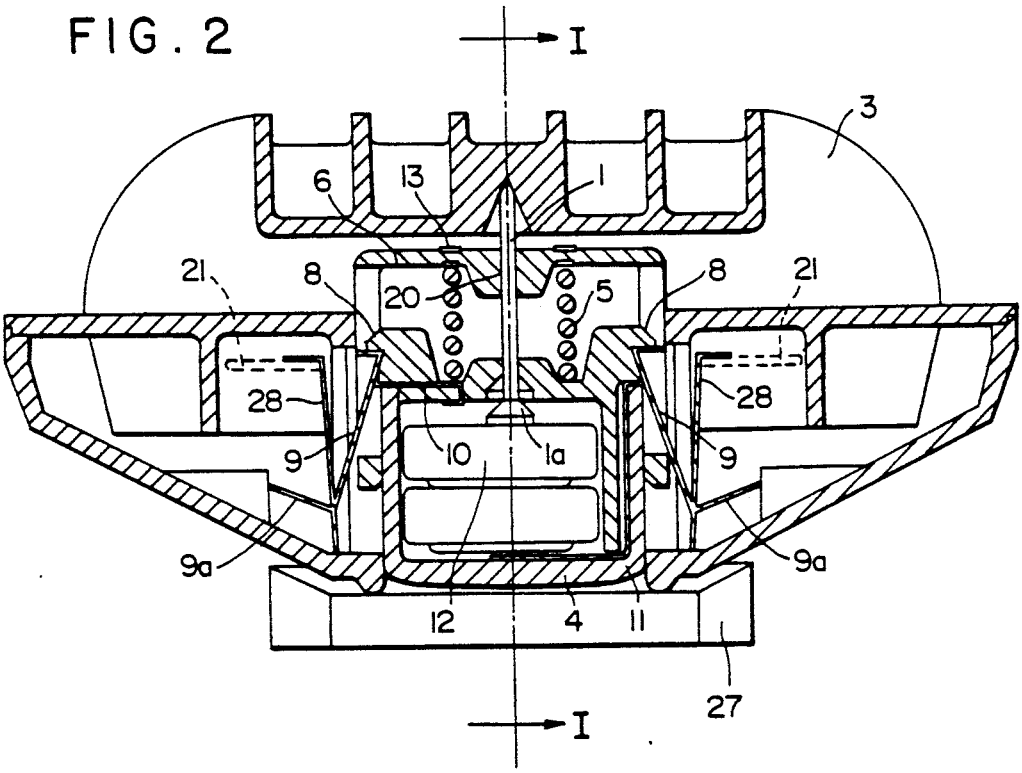
FIG. 2 is a cross-sectional view taken on the line II—II of FIG. 1.

FIG. 2 is a cross-section perpendicular to the section of FIG. 1, and shows the wafer in the closed position. At the end of push button 4 facing the clip, one or more projections 8 are provided. When push button 4 is depressed, catches 9 catch behind projections 8. In this situation, push button 4 cannot fall back into the open position, and the wafer is locked. In the example shown, catches 9 take the form of leaf spring catches. The wafer is removed by means of an uncoupling apparatus specially constructed for the purpose. Through one or more magnets, the leaf spring catches 9 are drawn into a position in which projections 8 are released, so that push button 4 and hence the needle can be moved to the outside or open position and the wafer removed from the object being safeguarded. The uncoupling apparatus may, for example, comprise an annular magnet, shown diagrammatically at 27 in FIG. 2, which is capable of attracting the curved sections 9*a* of catches 9, to cause the catches to pivot outwardly relatively to intermediate pieces 28 connected to them, and also connected to print 21, to release push button 4. In this example the intermediate pieces 28 also serve as contact strips.

The above-described basic construction of the wafer can be extended with an active alarm function. In that case, as shown in the cross-section of FIGS. 1 and 2, additional components are added. In push button 4, one or more batteries 12 are provided, together with two resilient contact lips 10 and 11 (FIG. 2). The leaf spring catches 9 in FIG. 2 are mounted either directly or through intermediate pieces 28, on a print 21, i.e., a wafer carrying an electronic printed circuit capable of generating an active alarm in the form of a bleep and/or a radio-frequency alarm signal, which is transmitted to a coil not shown and can be received, for example, by receivers mounted in the ceiling. Advantageously, the coil may be the coil of the conventional wafer circuit, which is present anyway. As shown in FIG. 2, the push button 4 is constructed so that, in the closed position of the wafer, battery 12 is pushed downwardly through needle 1 against the spring action of contact lip 11, so that the electrical connection between lip 10 and the battery is broken. In this situation no voltage is passed through the contact lips and the leaf spring catches to the print.

When the needle 1 can move further outwardly, for example, because it is cut, or the clip 3 is broken, then, under the influence of the spring pressure of lip 11, the battery will be pushed against contact lip 10, as a result of which supply voltage is passed to the electronic circuit on the print, and an alarm is generated. The electronic circuit may, for example, be an oscillator circuit. The wafer may also comprise a buzzer or the like to be energized by the batteries.

Figure 3:
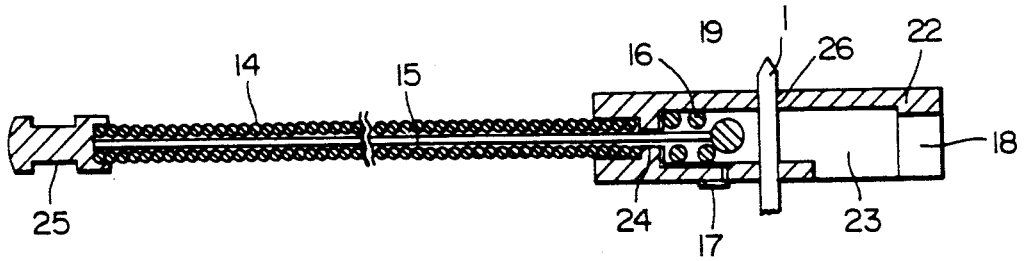
FIG. 3 is a cross-sectional view showing an example of an accessory with a cord for use with a detection label according to the invention.

FIG. 3 shows a cord, to which the alarm function can be transmitted, if it has been added to the wafer. For this purpose, the contact lip 10, as shown in FIG. 2, is arranged to make electrical contact with spring 5. Furthermore, at the top of fabric clamping device 6, a metal strip 13 is provided, which is also in electrical contact with spring 5.

The cord shown by way of example in FIG. 3 comprises a flexible tubular guide element, e.g. a closely-wound coiled metal spring 14, possibly provided with a plastic sheath, with a metal wire or cable 15 as a core. Metal wire 15 is fixed at one end of the cord to the metal spring 14, for example, through a weld or by being attached to an end member 26. The other end of the cord is provided with a hollow disk-shaped accessory 22 of insulating material, with the wire or cable 15 extending into the cavity 23 of accessory 22 through a radial bore 24. The end of wire or cable 15 in cavity 23 is provided with a cone or bead 19, and a helical compression spring 16, which tends to pull the bead, and hence wire 15, from the tube 14.

Accessory 22 comprises a contact lip 17 and a slot 18 forming a kind of fork in which a corresponding end piece 25 at the free end of the cord can be placed. If now the cord is inserted through an opening of the object to be safeguarded, and closed through slot 18, the wafer or label can be provided around the plastic part of the cord by shifting the clip of the label around it and inserting the needle of the label through the accessory, which is provided with a bore 26 for the purpose, and locking it. In this situation, lip 17 makes contact with metal strip 13 in the fabric clamping device. When the cord is now cut or broken, the bead 19 will be pushed into contact with needle 1 of the wafer under the influence of spring 16. In this way, voltage is passed through the print, whereby an alarm is generated, because the head 1a of the needle is in contact with one pole of the battery or batteries.

It is noted that, instead of the resilient contact lip 11, or in combination therewith, a compressive spring may be used between battery or batteries 12 and the end wall of push button 4. Also, it is not necessary for wire 15 to be made of metal or for tube 14 to be made of metal.

Figure 4:
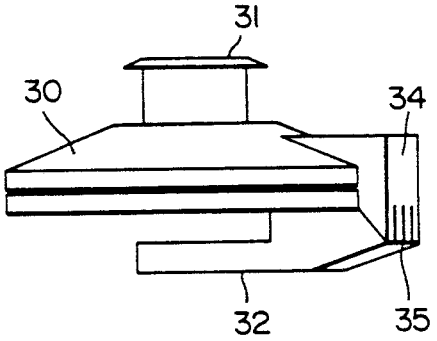
FIG. 4 is a side-elevational view, of a different embodiment of the detection label according to the invention in the inoperative position.
Figure 5:
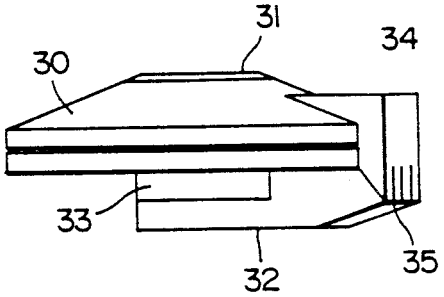
FIG. 5 is a view similar to FIG. 4 which shows the detection label of FIG. 4 in the operative position.

FIGS. 4 and 5 show diagrammatically, and in side-elevational view, an embodiment of a detection label according to the invention with a frustoconical housing 30. At the truncated top of the housing, a push button 31 is provided, which is shown in FIG. 4 in the inoperative position, in which it projects from the housing. The push button serves to operate the needle, not visible in FIGS. 4 and 5, in the manner described hereinbefore, in order to move it to the free end of the fixed clip 32 located opposite the base of the conical housing. In the situation shown in FIG. 5, the push button has been depressed and the needle extends into the cavity in the clip. The needle is not visible, however, because the fabric clamping device 33 has also been moved towards the clip in the manner described hereinbefore.

Push button 31 and housing 30 are designed so that the housing can be gripped by one hand and the push button operated with the same hand to push the needle through an opening in an article to be safeguarded or through the fabric of an article to be safeguarded. In the depressed position, the push button is preferably inaccessible from the outside, as shown in FIG. 5. Attempts at detaching or de-activating the detection label in an unauthorized manner are thus made more difficult.

Batteries placed in the push button can only be removed in the inoperative position, i.e., the non-depressed condition of the push button.

Clip 32 is connected to the rest of the housing through a connecting piece 34. In the embodiment shown, the connecting piece is provided with slots 35, which augment the audibility of an alarm buzzer or the like, if provided in the label.

FIGS. 6 to 10 show various sections of an additional embodiment of a detection label according to the invention. Corresponding parts are designated by the same reference numerals as used in FIGS. 1 and 2.

Figure 6:
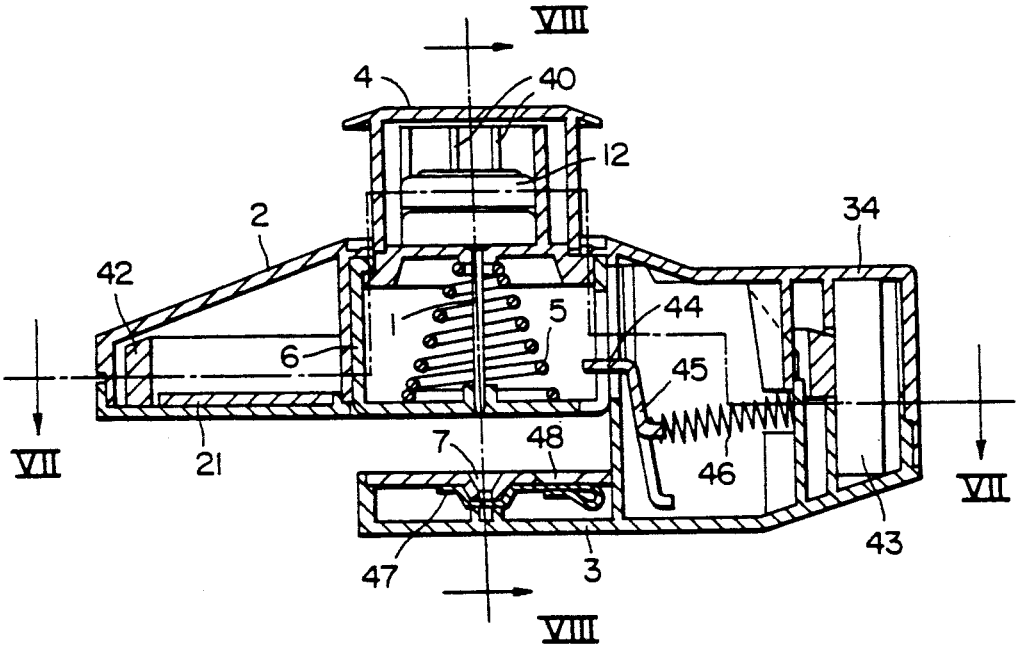
FIG. 6 is a vertical cross-sectional view, showing a further embodiment of the detection label of FIGS. 1 and 2.
Figure 8:
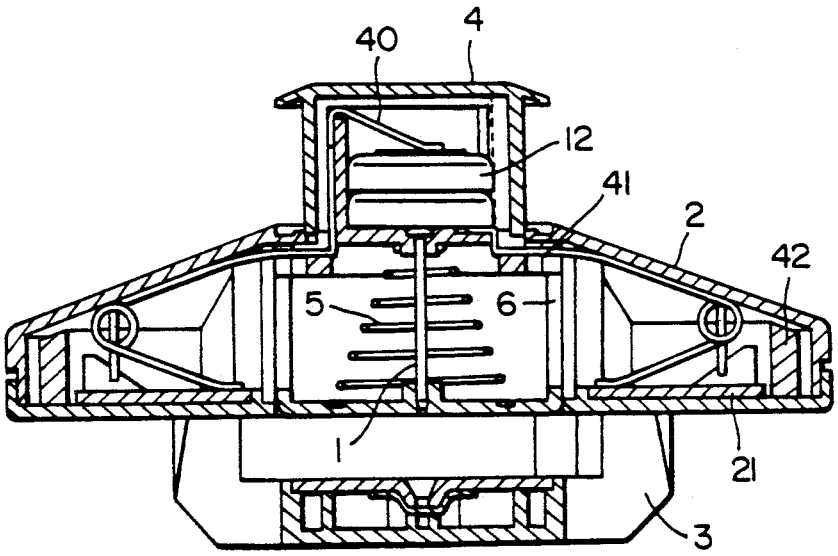
FIG. 8 is a cross-sectional view taken on the line VIII—VIII of FIGS. 6 and 7.

As in FIGS. 1 and 2, push button 4 is hollow, so that one or more batteries can be placed in it. For this purpose, for example, the push button may be provided with a cap which is detachable when the push button is in the inoperative position (FIG. 6). The batteries are pushed towards the head of needle 1 by a first contact spring 40 (FIG. 8). At the end of the needle head, there is further provided a second contact spring 41 (FIG. 8). In this example, the contact springs are continuously in contact with both the battery or batteries and the circuit on print 21, in contrast to the embodiment illustrated in FIGS. 1 and 2.

Figure 7:
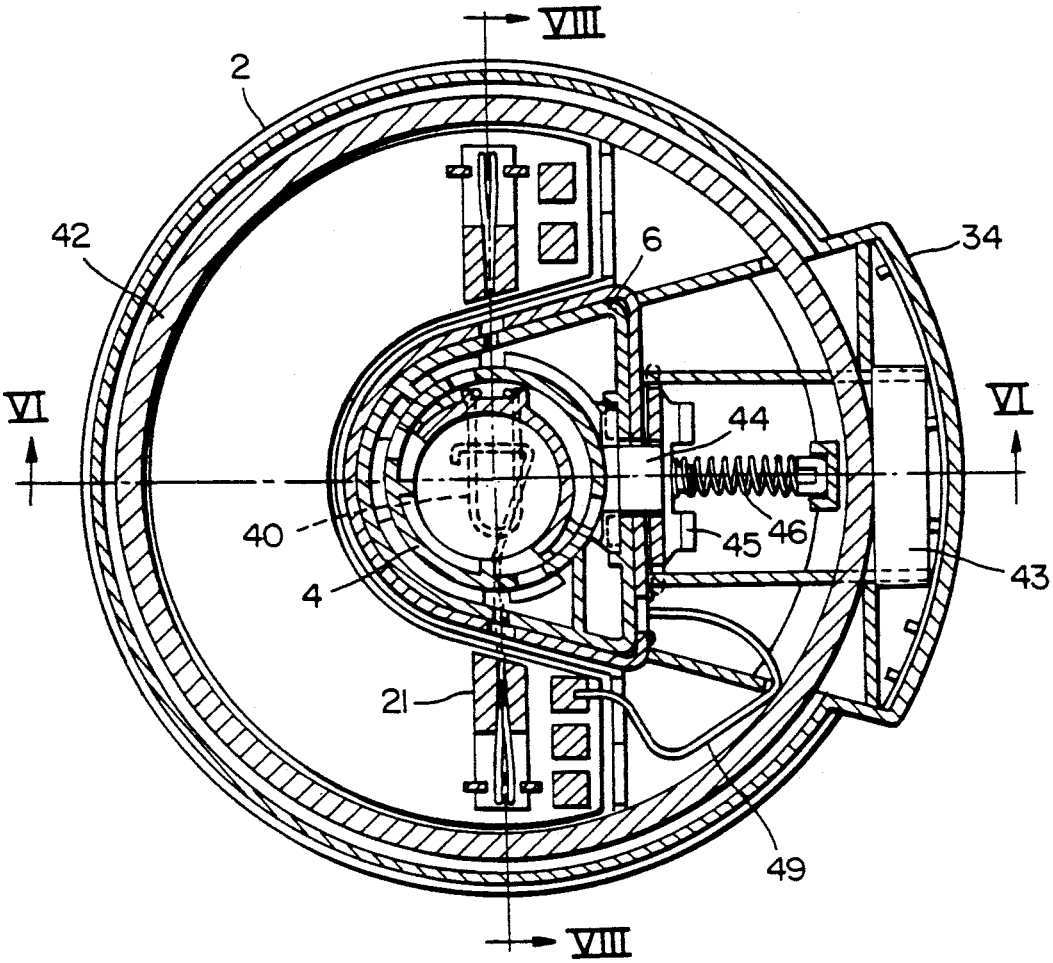
FIG. 7 is a cross-sectional view taken on the line VII—VII of FIG. 6.

The detection label of FIGS. 6–10 is accordingly arranged to detect the breaking of a connection and to generate an alarm signal in response thereto. FIGS. 6–8 show at 42 the coil of the passive circuit of the wafer. This coil may advantageously form part of the active alarm circuit of the wafer serving to generate an alarm signal when the wafer is being tampered with. Furthermore, a buzzer is shown at 43, which can be energized by the active alarm circuit. Other means capable of providing an acoustic alarm signal, such as a piezoelectric bleeper, for example, are also applicable.

Figure 9:
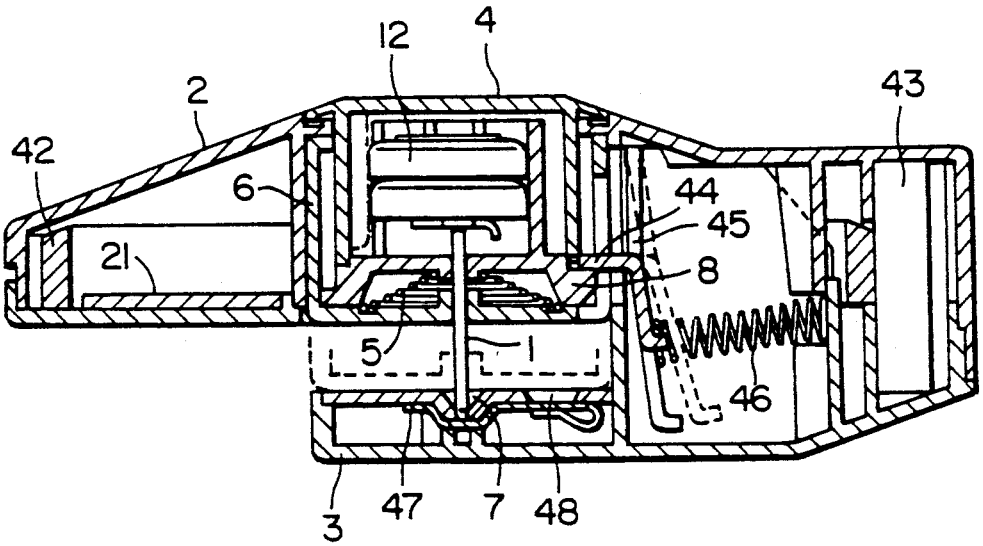
FIG. 9 is a view similar to FIG. 6 showing the detection label in the operative condition.
Figure 10:
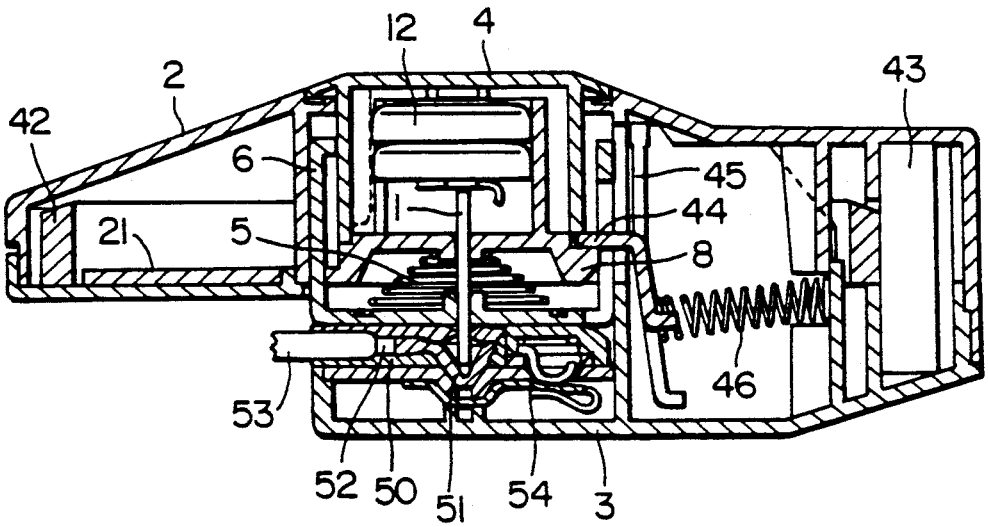
FIG. 10 shows the detection label in cooperation with an accessory provided with a cord.

FIG. 6 shows the detection label in the inoperative condition. In that condition needle 1 is fully within fabric clamping device 6 surrounding the push button. Fabric clamp 6 has a slot 56 through which a lip 44 of a locking pawl 45 extends into the space within the fabric clamp. Pawl 45 is biased by a compression spring 46, and is capable to pivot against the action of spring 46, as shown by broken lines in FIG. 9. FIGS. 9 and 10 show the wafer in the operative condition. Push button 4 has been depressed, and lip 44 of pawl 45 is behind the shoulder 8 of the push button and thus prevents the push button from moving outwards again. Pawl 45 can be unlocked magnetically in known manner when the wafer is placed in an unlocking device provided for the purpose.

FIG. 9 shows the detection label in the condition in which thick material is clamped between clip 3 and fabric clamping device 6. The broken lines indicate the position of the fabric clamp if no material, or very thin material has been placed between the fabric clamp and the clip.

As shown in FIG. 9, a contact spring 47 is provided in clip 3 which in the operative condition of the wafer makes contact with needle 1 and, through the needle, with one pawl of the battery (batteries) 12. Contact spring 47 is accommodated in cavity 7 of the clip, but in this example, for reasons to be described hereinafter, also extends below an aperture 48 in clip 3 opening towards the fabric clamp.

Through a wire 49 (FIG. 7), contact spring 41 is further connected to the electrical circuit of the wafer. If it is tried to pry loose the detection label, or to cut the needle or the like, the circuit of the battery through the needle, the contact spring and wire 49 to the electrical circuit is at least temporarily broken. The electrical circuit is arranged to generate an alarm signal in that case, for example, by energizing an acoustic device 43 and/or transmitting a radio-frequency signal.

In this embodiment, too, an accessory with a cord can be used to safeguard articles which cannot be secured with a needle. Such an accessory is shown at 50 in FIG. 10. The accessory shown again has an opening for receiving the tip of needle 1. Located behind the opening is a contact lip 51 connected to conductor 52 of an electrical cord 53, which is at one end fixedly connected to the accessory. The contact lip 51 is clear of the contact spring. The other end of the electrical cord is provided with a second contact lip 54, which is also connected to conductor 52, and can be hooked into a cavity 48 of the accessory. The second contact lip 54 is shaped so that, if the accessory is placed in the wafer, lip 54 makes contact with contact spring 47 through the opening 48 in the clip. In this way, a closed circuit is again formed through the needle, the first contact lip 51, the cord, the second contact lip 54, the contact spring 47 in the clip and wire 49, which circuit is interrupted when the cord is severed or pulled loose. Such an interruption leads again to an alarm signal being generated.

A detection label or wafer according to the invention can advantageously be designed so that the use of the passive form, i.e., that without a battery or batteries, and the active form in one and the same anti-shoplifting system is possible. Passive wafers, which may be of the known type, but also of the type according to the present invention with a fixed clip, are then for example used for normal articles, and the active wafers for more expensive articles.

It is noted that, after reading the above, various modifications will readily occur to those skilled in the art. Thus, for example, it is possible to have both the passive and the active wafers generate a coded signal when activated by an interrogation field and/or by fraudulent operations. The code may be related, for example, to the nature of the article being safeguarded. One example of an electrical circuit suitable for this purpose is described in Netherlands patent 176 404. These and similar modifications are considered to fall within the scope of the present invention.

What I claim is:

1. A detection label for an anti-shoplifting system attachable to an article to be safeguarded comprising:
- a housing;
- a fixed clip on said housing having a part thereof spaced from a part of said housing forming a slot in said housing for insertion of a part of the article to be safeguarded;
- a needle in said housing having a shank, an article piercing tip on one end thereof and a head on the other end thereof for attaching the detection label to the article in a secured position;
- operating means movably mounted in said housing and engaging said needle for moving said needle and said tip thereof toward said clip into said secured position;
- guiding means in said housing for guiding said needle during said movement of said needle;
- a cavity in said clip for receiving said tip of said needle in said secured position;
- locking means for locking said needle in said secured position; and
- electrical circuit means in said housing detectable by an electromagnetic interrogation field;
- said operating means comprising a push button engageable with said head of said needle; and
- said guiding means comprising a fabric clamping device resiliently coupled to said push button and having a bore therein through which said shank of said needle extends.

2. A detection label as claimed in claim 1 and further comprising:
- a hollow interior in said push button;
- two contact springs in said housing having spaced contact lips thereon extending into said hollow interior of said push button; and
- at least one battery in said hollow interior between said spaced contact lips and electrically engageable therewith.

3. A detection label as claimed in claim 2 wherein:
- said contact springs comprise part of said locking means and are electrically connected to said electrical circuit means; and
- said at least one battery is electrically engaged with said contact lips when said needle is not in said secured position.

4. A detection label as claimed in claim 3 wherein:
- said at least one battery is movable in said hollow interior between contact lip engaging and disengaged positions; and
- when said needle is in said secured position, said needle head engages against said at least one battery and moves said at least one battery into said contact lip disengaged position.

5. A detection label as claimed in claim 4 and further comprising:
- an electrically conductive compression spring disposed between said push button and said fabric clamping device resiliently urging said push button away from said clip, said compression spring being in contact with one of said contact lips.

6. A detection label as claimed in claim 5 and further comprising:
- a contact strip on said fabric clamping device in contact with said compression spring;
- an accessory removably insertable in said slot between said fabric clamping device and said clip;
- a central space in said accessory;
- a bore in said accessory for removably receiving said needle therethrough; and
- an attachment cord having one end fixedly connected to said accessory and means for detachably connecting the other end of said cord to said accessory;
- said cord comprising a flexible tubular housing and a core within said flexible tubular housing, said core having one end extending into said central space in said accessory, the other end of said core being fixedly connected to said flexible tubular housing, an enlarged metallic element on said one end of said core, a spring between said accessory and said enlarged metallic element resiliently urging said enlarged metallic element toward said bore in said accessory, a further contact strip on said accessory having a part thereof engageable with said contact strip on said fabric clamping device when said accessory is inserted in said slot.

7. A detection label as claimed in claim 2 wherein:
- means are provided for electrically connecting said contact springs with said electrical circuit;
- said head of said needle is in contact with one pole of said at least one battery;
- an additional contact spring is provided in said clip engageable with said needle when in said secured position and electrically connected to the electrical circuit; and
- the electrical circuit is arranged so that an alarm signal is generated when said contact between said needle and said additional contact spring is broken.

8. A detection label as claimed in claim 1 wherein:
- said electrical circuit means comprises a code generator for generating a coded signal.

9. A detection label as claimed in claim 1 wherein:
- said electrical circuit means comprises a transmission section for transmitting a radiographic alarm signal.

10. A detection label as claimed in claim 1 and further comprising:
- an acoustic alarm generator within said housing connected to said electrical circuit means for operation thereby.

11. A detection label as claimed in claim 10 and further comprising:
- openings in said housing in proximity to said acoustic alarm generator.

12. A detection label for an anti-shoplifting system attachable to an article to be safeguarded comprising:
- a housing;
- a fixed clip on said housing having a part thereof spaced from a part of said housing forming a slot in said housing for insertion of a part of the article to be safeguarded;

a needle in said housing having a shank, an article piercing tip on one end thereof and a head on the other end thereof for attaching the detection label to the article in a secured position;

operating means movably mounted in said housing and engaging said needle for moving said needle and said tip thereof toward said clip into said secured position;

guiding means in said housing for guiding said needle during said movement of said needle;

a cavity in said clip for receiving said tip of said needle in said secured position;

locking means for locking said needle in said secured position; and electrical circuit means in said housing detectable by an electromagnetic interrogation field;

said locking means comprising a shoulder on said operating means and at least one catch in said housing engaging behind said shoulder when said needle is in said secured position.

13. A detection label as claimed in claim 12 wherein:

said at least one catch is removably engageable with said shoulder and magnetically attractable so that said at least one catch is unlockable by magnetic means.

14. A detection label for an anti-shoplifting system attachable to an article to be safeguarded comprising:

a housing having a frustoconically shaped part;

a fixed clip on said housing having a part thereof spaced from the larger base of said frustoconically shaped part forming a slot in said housing for insertion of a part of the article to be safeguarded;

a broadened intermediate part on said housing connecting said clip to an edge portion of said frustoconically shaped part;

a needle in said housing having a shank, an article piercing tip on one end thereof and a head on the other end thereof for attaching the detection label to the article in a secured position;

a push button operating means movably mounted in said housing for passing through the smaller base of said frustoconically shaped part and being fully enclosed within said housing when depressed in said secured position, said push button operating means engaging said needle for moving said needle and said tip thereof toward said clip into said secured position;

guiding means in said housing for guiding said needle during said movement of said needle;

a cavity in said clip for receiving said tip of said needle in said secured position;

locking means for locking said needle in said secured position; and electrical circuit means in said housing detectable by an electromagnetic interrogation field.

15. A detection label as claimed in claim 14 and further comprising:

an acoustic alarm generator in said intermediate part connected to said electrical circuit means to be operated thereby.

16. A detection label for an anti-shoplifting system attachable to an article to be safeguarded comprising:

a housing;

a fixed clip on said housing having a part thereof spaced from a part of said housing forming a slot in said housing for insertion of a part of the article to be safeguarded;

a needle in said housing having a shank, an article piercing tip on one end thereof and a head on the other end thereof for attaching the detection label to the article in a secured position;

operating means movably mounted in said housing and engaging said needle for moving said needle and said tip thereof toward said clip into said secured position;

guiding means in said housing for guiding said needle during said movement of said needle;

a cavity in said clip for receiving said tip of said needle in said secured position;

locking means for locking said needle in said secured position; and electrical circuit means in said housing detectable by an electromagnetic interrogation field.

17. A detection label as claimed in claim 16 wherein:

said electrical circuit means comprises a code generator for generating a coded signal.

18. A detection label as claimed in claim 16 wherein:

said electrical circuit means comprises a transmission section for transmitting a radiographic alarm signal.

19. A detection label as claimed in claim 16 and further comprising:

an acoustic alarm generator within said housing connected to said electrical circuit means for operation thereby.

20. A detection label as claimed in claim 19 and further comprising:

openings in said housing in proximity to said acoustic alarm generator.

* * * * *